US011151906B2

(12) United States Patent
Cerniglia

(10) Patent No.: US 11,151,906 B2
(45) Date of Patent: Oct. 19, 2021

(54) SYSTEM AND METHOD FOR IDENTIFYING AND MATCHING CORRESPONDING COMPONENTS IN AN APPARATUS

(71) Applicant: Anthony Cerniglia, Wauconda, IL (US)

(72) Inventor: Anthony Cerniglia, Wauconda, IL (US)

( * ) Notice: Subject to any disclaimer, the term of this patent is extended or adjusted under 35 U.S.C. 154(b) by 0 days.

(21) Appl. No.: 17/001,354

(22) Filed: Aug. 24, 2020

(65) Prior Publication Data

US 2020/0394938 A1 Dec. 17, 2020

Related U.S. Application Data

(63) Continuation-in-part of application No. 16/541,093, filed on Aug. 14, 2019, now Pat. No. 10,756,460.

(60) Provisional application No. 62/718,467, filed on Aug. 14, 2018.

(51) Int. Cl.
*G09F 3/02* (2006.01)
*G09F 3/00* (2006.01)

(52) U.S. Cl.
CPC ..... *G09F 3/02* (2013.01); *G09F 3/0295* (2013.01); *G09F 2003/0227* (2013.01)

(58) Field of Classification Search
CPC ..... H01R 9/2475; G09F 3/0295; G09F 2003/0208
See application file for complete search history.

(56) References Cited

U.S. PATENT DOCUMENTS 4,361,230 A * 11/1982 Downing ..... H01B 7/368 206/345
4,363,401 A * 12/1982 Savagian ..... G09F 3/0295 174/DIG. 8
4,578,136 A * 3/1986 Brown ..... G09F 3/10 156/215
6,420,657 B1 * 7/2002 Fang ..... G09F 3/0295 174/112
6,718,674 B2 * 4/2004 Caveney ..... G09F 3/20 40/611.09
7,612,288 B1 * 11/2009 Gundogan ..... H01R 9/2475 174/112
2003/0019732 A1 * 1/2003 Hunt ..... H01H 9/18 200/309
2004/0084486 A1 * 5/2004 Raterman ..... B05C 11/10 222/529
2004/0164544 A1 * 8/2004 Thall ..... G09F 3/005 283/62
2009/0139743 A1 * 6/2009 Smith ..... G09F 3/0295 174/112
2010/0154800 A1 * 6/2010 Chang ..... A61M 16/04 128/207.15

(Continued)

*Primary Examiner* — Gary C Hoge
(74) *Attorney, Agent, or Firm* — Lempia Summerfield Katz LLC

(57) ABSTRACT

An inlay or identifier element system for identifying and/or matching corresponding parts of an apparatus includes a color coding or other indicia on a visible surface of an inlay and a pocket formed in a surface of the apparatus. The inlay is inserted in the pocket, which is positioned to identify a first part of the apparatus. A matching color coding or indicia is on a second part of the apparatus to be coupled to the first part. The visible surface of the inlay is flush with or sub flush with a portion of the surface of the apparatus that surrounds the pocket.

20 Claims, 13 Drawing Sheets

(56) References Cited

U.S. PATENT DOCUMENTS

| | | | | |
|---|---|---|---|---|
| 2010/0205842 | A1* | 8/2010 | Halimi | G09F 3/205 40/642.01 |
| 2012/0048404 | A1* | 3/2012 | Lake | F16L 41/03 137/551 |
| 2012/0301084 | A1* | 11/2012 | Kozischek | H01B 7/368 385/76 |
| 2014/0068983 | A1* | 3/2014 | Adams | G09F 1/10 40/662 |
| 2014/0082980 | A1* | 3/2014 | Sherman | G09F 3/205 40/316 |
| 2015/0040447 | A1* | 2/2015 | Ganster | G09F 3/0295 40/647 |
| 2015/0213736 | A1* | 7/2015 | Larsen | G09F 3/06 29/453 |
| 2015/0349450 | A1* | 12/2015 | Omari | H01R 13/6456 439/491 |
| 2017/0018209 | A1* | 1/2017 | Walley, Jr. | E03C 1/00 |
| 2017/0366110 | A1* | 12/2017 | Omari | H05K 1/00 |
| 2018/0053444 | A1* | 2/2018 | Houghton-Renyard | G09F 21/04 |
| 2018/0282583 | A1* | 10/2018 | Inoue | G09F 3/10 |
| 2018/0286289 | A1* | 10/2018 | Liversidge | H01B 7/368 |
| 2019/0030941 | A1* | 1/2019 | Murayama | B41M 5/502 |

* cited by examiner

RED =

BLUE =

RED =

BLUE =

SYSTEM AND METHOD FOR IDENTIFYING AND MATCHING CORRESPONDING COMPONENTS IN AN APPARATUS

RELATED APPLICATION DATA

This patent is a continuation-in-part application entitled to the benefit of and claims priority to co-pending U.S. Non-Provisional application Ser. No. 16/541,093 filed Aug. 14, 2019 and entitled "System and Method for Identifying and Matching Corresponding Components in an Apparatus", which claims priority to and the benefit of U.S. Provisional Application Ser. No. 62/718,467 filed Aug. 14, 2018 and entitled "System and Method for Matching Corresponding Components in an Apparatus." The entire contents of these prior filed applications are hereby incorporated herein by reference.

BACKGROUND

1. Field of the Disclosure

The present disclosure is generally directed to matching components for an apparatus, and more particularly to a system and method for identifying matching or related components in an apparatus utilizing various indicia on the components.

2. Description of Related Art

A uniform system and method of adding common and custom indicia on tooling for manufacturing may be useful for at least two business types and provide a novel improvement over existing systems and methods. The first business type includes those who construct the tooling and the second business type includes those who use the tooling to manufacture parts. Hereinafter, the first types are referred to as the fabricators and the second types are referred to as the end users. These terms may be overly limiting in some manufacturing environments. For example, the fabricators may include assemblers and installers of the tooling and the end users may include on-site installers and other users of the tooling.

These tools most often require one or more sources of complementary peripheral services when in production. These services can include recirculating cooling mediums, compressed air, vacuum, hydraulic and electrical auxiliary equipment, and more for a single tool. These services necessitate connecting and disconnecting tooling components to the appropriate supply source and/or interfacing with various controls to facilitate proper function.

To address the first group, the fabricators, methods like stamping, engraving, and laser systems have been used to identify certain connection sites as well as to add other useful nomenclature for proper function. The size range of tooling componentry and/or the availability of certain machine tools often dictates the methodology of adding common indicia.

The prior methods are deficient in their application. Stamping requires personnel to select each stamp, align, and then strike the stamp with a mallet to make an impression in the material. This method is time-consuming, aesthetically inferior, and dangerous. This method has caused many injuries over the course of manufacturing.

Proper engraving requires the use of special cutters, which can run at spindle speeds exceeding 50,000 RPM, and which can require special software and programming. Engraving, when applied to larger mold tooling plates, requires equally large machine tools. These machine tools for larger plates are typically configured for removing larger amounts of material. This configuration will combine high horsepower and torque in lieu of high RPM required for proper engraving. Therefore, a compromise is generally made to inefficiently engrave in this machine tool to avoid the time-consuming process of setting up another machine tool or special auxiliary high-speed head in the larger machine.

The laser marking requires a laser system, which is not commonly found in most fabricator's shops. The plate sizes would also require that the system be somehow portable to the fabricator's facility, as the plate sizes would likely be much larger than the laser machine itself.

To address the second group, the end users, while common methods like stamping, engraving, and laser marking perform as required, these methods are limited in providing cost-effective data for their intended use. For reference, in the case of a large injection mold, it is not uncommon to have fifty (50) or more water circuits for temperature control. These circuits each have the desired flow path usually indicated with stamped or engraved text stating "IN" or "OUT" and indicating the circuit number. Additionally, this same mold could very well have an air poppet device requiring compressed air, a vacuum draw to evacuate air from the mold cavity, cavity pressure sensors for mold filling, a hot runner system requiring electrical connections, and/or several threaded holes for lifting the mold to the mold press or for the individual plates during assembly and disassembly. Indicia for these services is helpful for efficient setup and for the production process.

SUMMARY

In one example, according to the teachings of the present disclosure, an inlay system for identifying and/or matching corresponding parts of an apparatus includes a color coding or other indicia on a visible surface of an inlay and a pocket formed in a surface of the apparatus. The inlay is inserted in the pocket, which is positioned to identify a first part of the apparatus. A matching color coding is on a second part of the apparatus to be coupled to the first part. The visible surface of the inlay is flush with or sub flush with a portion of the surface of the apparatus that surrounds the pocket.

In one example, the inlay can be provided on and removable from a card carrying a plurality of inlays.

In one example, a card can carry a plurality of the inlays and can have a metal substrate.

In one example, the inlay can include multiple indicia on the visible surface indicative of characteristics of the first part of the apparatus.

In one example, the matching color coding can be on an identifier element attached to the second part of the apparatus.

In one example, the inlay system can include one or more additional pockets formed in the surface or in one or more additional surfaces of the apparatus. Each of the plurality of pockets can contain an inlay with color coding and can be positioned to identify a different part of the apparatus. Each of the inlays can have a visible surface that is flush with or sub flush with a portion of the corresponding surface that surrounds the respective pocket.

In one example, the system can be configured to be used by at least one of fabricators during fabrication of the apparatus or end users during installation or set up of the apparatus.

In one example, the apparatus can be molding equipment having at least one of recirculating cooling mediums, compressed air equipment, vacuum equipment, hydraulic auxiliary equipment, electrical auxiliary equipment, hoist rings, and/or eyebolts. The system can be applied to any one or more of these on the molding equipment.

In one example, the apparatus can be industrial tooling with a first part and one or more second parts that can be connected to the first part and configured to provide one or more peripheral services to the first part.

In one example, the one or more second parts can be configured to connect to a first part of the apparatus to provide one or more peripheral services to the apparatus. The one or more peripheral services can include compressed air, oil, heating fluid, and/or cooling fluid.

In one example according to the teachings of the present disclosure, a method for identifying and matching corresponding components in an apparatus includes attaching a first inlay on a first part of an apparatus within a pocket formed in a surface of the first part. The first inlay carries at least one indicia on a visible surface indicative of a first characteristic of the first part. The method includes attaching a second element on a second part of an apparatus. The second element carries a matched indicia to the at least one indicia indicative of a second characteristic of the second part that corresponds to or matches the first characteristic of the first part. The visible surface of the first inlay is flush with or sub flush with a portion of the surface of the apparatus that surrounds the pocket.

In one example, the step of attaching a second element can include positioning an identifier element around a portion of the second part.

In one example, the matched indicia and the at least one indicia can be the same color, the same number, the same word, or any combination thereof.

In one example, the at least one indicia can include connector size, style, or type information, or any combination thereof, and the matched indicia can include matching connector information.

In one example according to the teachings of the present disclosure, a system for identifying or matching corresponding components of an apparatus includes pockets formed in corresponding surfaces of the apparatus. Each pocket is disposed adjacent a different part of the apparatus. An inlay is disposed in each of the pockets and each inlay has at least one indicium associated with a specific characteristic of the corresponding different part of the apparatus. The at least one indicium is on a visible surface of the respective inlay and the visible surface is flush with or sub flush with a portion of the corresponding surface of the apparatus that surrounds the respective pocket. The system includes other parts and each other part has a characteristic that corresponds to the specific characteristic of one of the different parts and is configured to be coupled to the respective one of the different parts. The system also includes an element carried on each of the other parts. Each element has an indicium that matches the at least one indicium of the inlay associated with the respective one of the different parts.

In one example, the apparatus of the system can be molding equipment and can have at least one of recirculating cooling mediums, compressed air equipment, vacuum equipment, hydraulic auxiliary equipment, electrical auxiliary equipment, hoist rings, and/or eyebolts. The system can be applied to any one or more of these on the molding equipment.

In one example, the apparatus of the system can be industrial tooling and the other parts can be configured to provide one or more peripheral services to the apparatus.

In one example, the other parts can be configured to provide peripheral services to the apparatus and the one or more peripheral services can include compressed air, oil, heating fluid, and/or cooling fluid.

In one example, an indicia element of a disclosed system or method can be disposed around a connector from a supply, such as an air or water supply.

In one example, an inlay element of the disclosed system or method can be disposed in a pocket on a supply receiver, such as an air or water supply receiver.

In one example, inlays and identifier elements of the disclosed a system or method can each having color coding, a connector number, and a connector size as indicia.

In one example, an identifier element and/or an inlay of the disclosed system or method can be formed of or include a resin, a metal layer, or both.

BRIEF DESCRIPTION OF THE DRAWINGS

The drawings provided herewith illustrate one or more examples or embodiments of the disclosure and therefore should not be considered as limiting the scope of the disclosure. There may be other examples and embodiments that may be equally effective to achieve the objectives and that may fall within the scope of the disclosure. Objects, features, and advantages of the present invention will become apparent upon reading the following description in conjunction with the drawing figures, in which.

The use of the same reference numbers or characters throughout the description and drawings indicates similar or identical components, aspects, and features of the disclosure.

DETAILED DESCRIPTION OF THE DISCLOSURE

As tooling, such as molding equipment or other industrial tooling, has grown more complex, there is a need to provide more detailed information on the tooling without increasing the cost, the physical size, or the time to do so for the fabricators. Likewise, end users need more useful indicia that not only adds information, but also provides color coding to make the assembly much easier and more efficient, as well as to assist with non-English speaking personnel, for final assembly, to simplify set-up, and/or to make repairs easier and more efficient. For example, it is not common for an injection mold to be built in the U.S. and then be shipped to another country and vice versa. Minimally, the addition of color coding, as well as simple numeric or graphic indicia, can greatly assist in communicating across language barriers.

This patent describes and discloses a system and method of identification and matching that combines color coding along with more informative indicia, applied with greater efficiency, for both the fabricators and the end users. The system and method employ graphic inlay labels, i.e., inlays and may incorporate other labelling mechanisms as well. The system and method include providing recesses or pockets on components of an apparatus, such as a mold tool and a set of inlays sized to fit the pockets. The inlays are selectively placed in the pockets to assist in identifying and matching various aspects, components, and/or systems of the apparatus to one another. The inlay product allows for the use of a standard cutter to cut a simple pocket in which a selected inlay can nest.

Addressing injection molds and water circuits directly, it is common in the industry to mark either "IN" or "OUT" and to include the circuit or connector number. The standard industry marking, however, does not provide relevant information as to the size of the pipe tap or the connector size required for the various connections. For a fabricator to add this more relevant information would more than double the design, set-up, programming, and cutting time required for the engraving or other known marking methods. Whereas a simple pocket to accept a high resolution, digitally printed inlay would be much more cost effective for the fabricator.

Figure 1:
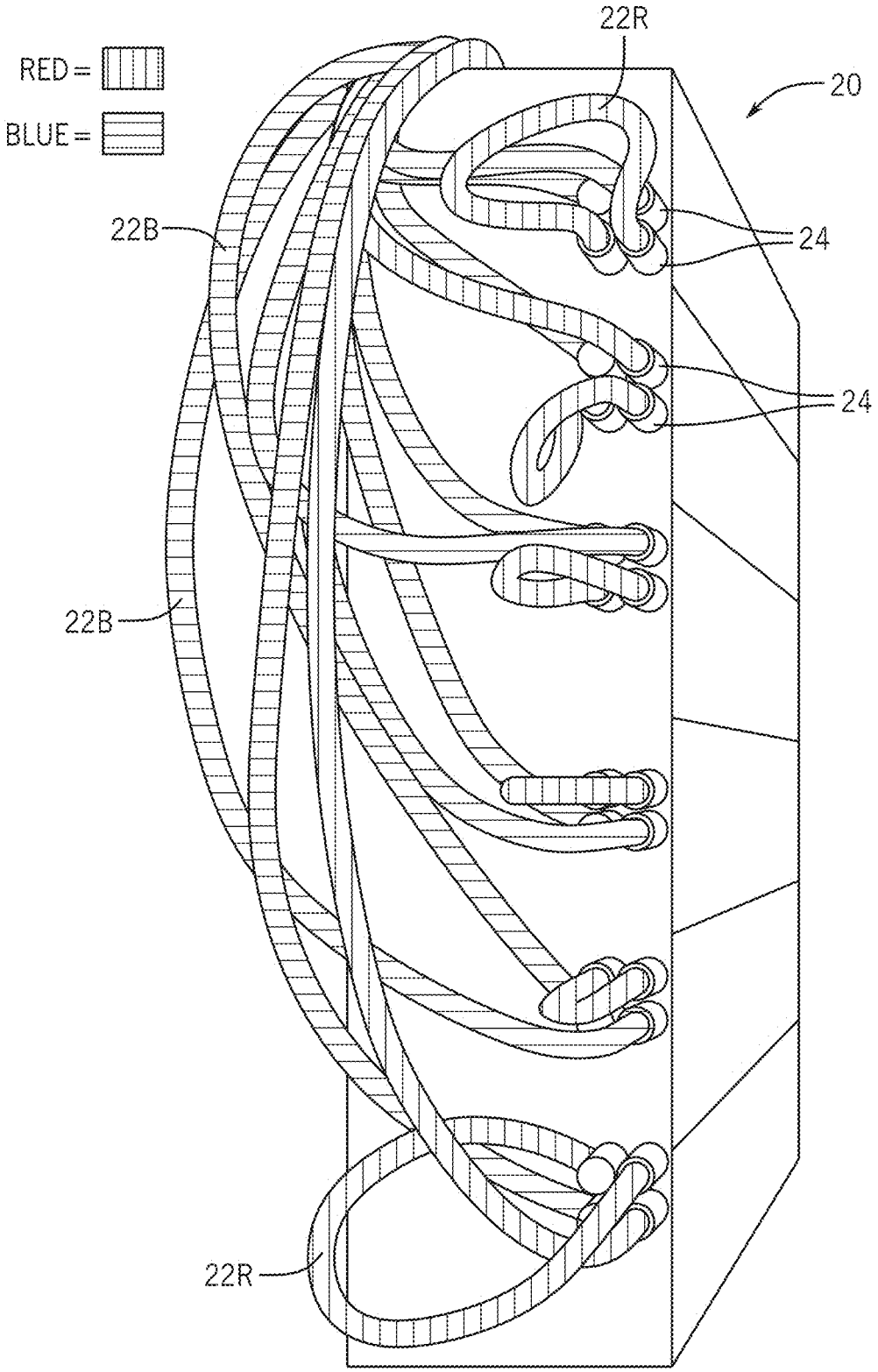
FIG. 1 shows an example of a conventional mold half with various water connections.
Figure 2:
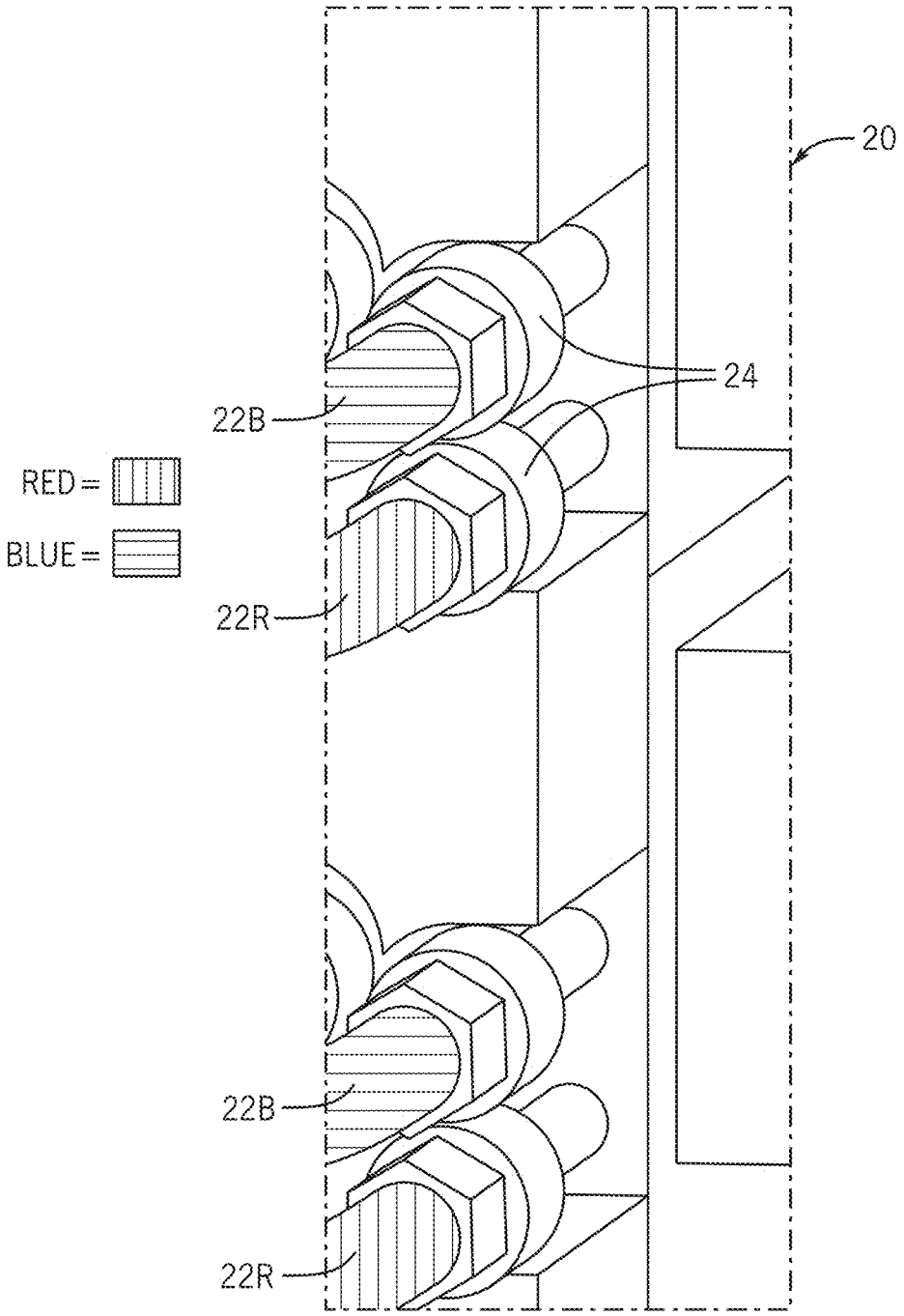
FIG. 2 shows an enlarged view of a portion of the water connections depicted in FIG. 1.

FIGS. 1 and 2 show one example of a mold half 20 with various water lines 22R and 22B and connectors 24 coupled to inlet and outlet ports of the mold half. The water lines 22B and 22R direct water to and from the mold half to aid in cooling the mold half during use, as is known in the art. The red hoses 22R can be said to connect to the "OUT" or outlet ports and the blue hoses 22B connect to the "IN" or inlet ports as is more easily seen in the enlarged FIG. 2 image. In existing process and applications, there is no color on the tooling to assist with the hose connections. Additionally, when this tool or mold half 20 requires disassembly and/or repair, maintenance personnel would not know the connector or pipe tap size upon reassembly.

Figure 3:
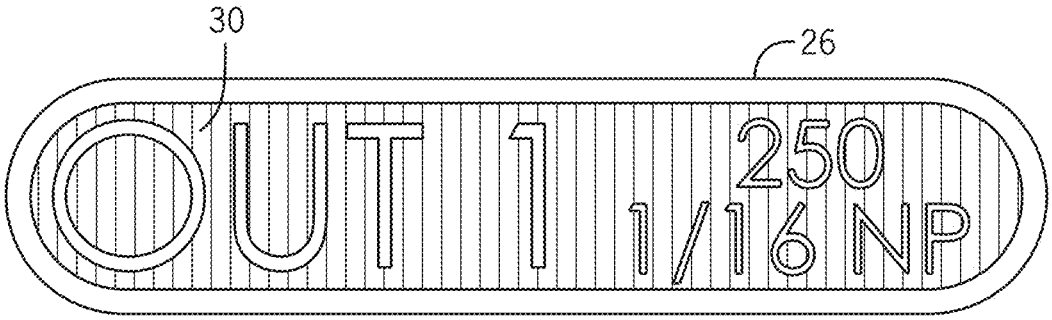
FIGS. 3 and 4 show examples of digitally printed, different color inlays according to the teachings of the present disclosure.
Figure 4:
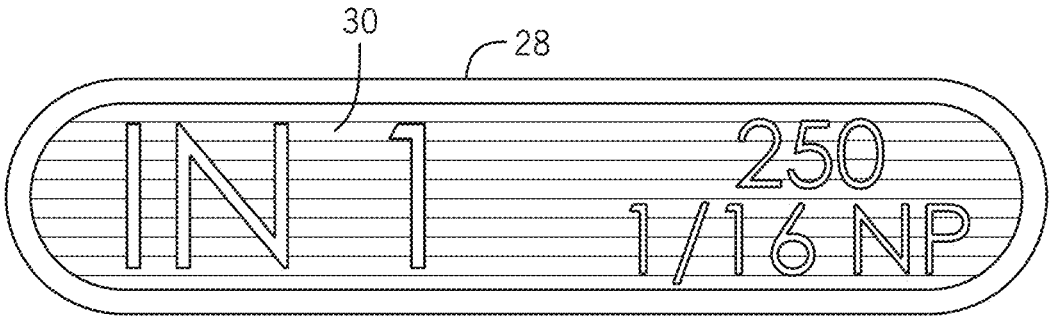

FIGS. 3 and 4 show two examples of digitally printed color inlays 26 and 28, respectively, according to the teachings of the present disclosure. Each of the inlays 26 and 28 has a front surface or label surface 30. This label surface can include various indicia and coding to readily convey information to a user of the mold tool or part. For example, each inlay 26 and 28 can be color coded with a background color, such as red for the inlay 26 and blue for the inlay 28. The color can be used to correlate and identifying a flow direction, i.e., whether a port or connection point of a mold part is for an inlet or an outlet fitting or hose connection. Each inlay can also include other useful indicia as well. In this example, each inlay 26 and 28 also includes alphanumeric symbols identifying flow direction, such as "IN" or "OUT" printed over the color background. In this example, the inlays 26 and 28 can also include a numeric symbol or alphanumeric character, such as "1, 2, 3, . . . " et. seq. to identify a specific section or circuit of a system of the mold part 20. In this example, each inlay 26 and 28 can also include a pipe fitting or tap size indicia, such as "1/16, 1/8, 1/4, . . . or the like. In this example, each inlay 26 and 28 can also include information that identifies a max load or the like, such as 250 fpm or the like. The indicia and coding on the inlays can be varied according to the needs of a particular application, as can the number of variables for each indicium provided on the inlays.

The digitally printed color inlays 26 and 28, as shown in FIGS. 3 and 4, can be employed to solve the above noted deficiencies. The color coding, flow direction, circuit or connector number, as well as the connector size, pipe thread size, and the like may be clearly indicated on the surface 30 of an inlay. These provide complete information regarding the circuit and can assist with non-English speaking personnel. The shape of a given inlay can also be used as an indicator or identifier, if desired, and as shown and described further below. The shape of an inlay can also be used to identify or distinguish one type of inlay from another type. The inlays 26 and 28 of FIGS. 3 and 4 are oval shaped. Other shapes may be used instead or in addition to the oval shape.

Figure 5:
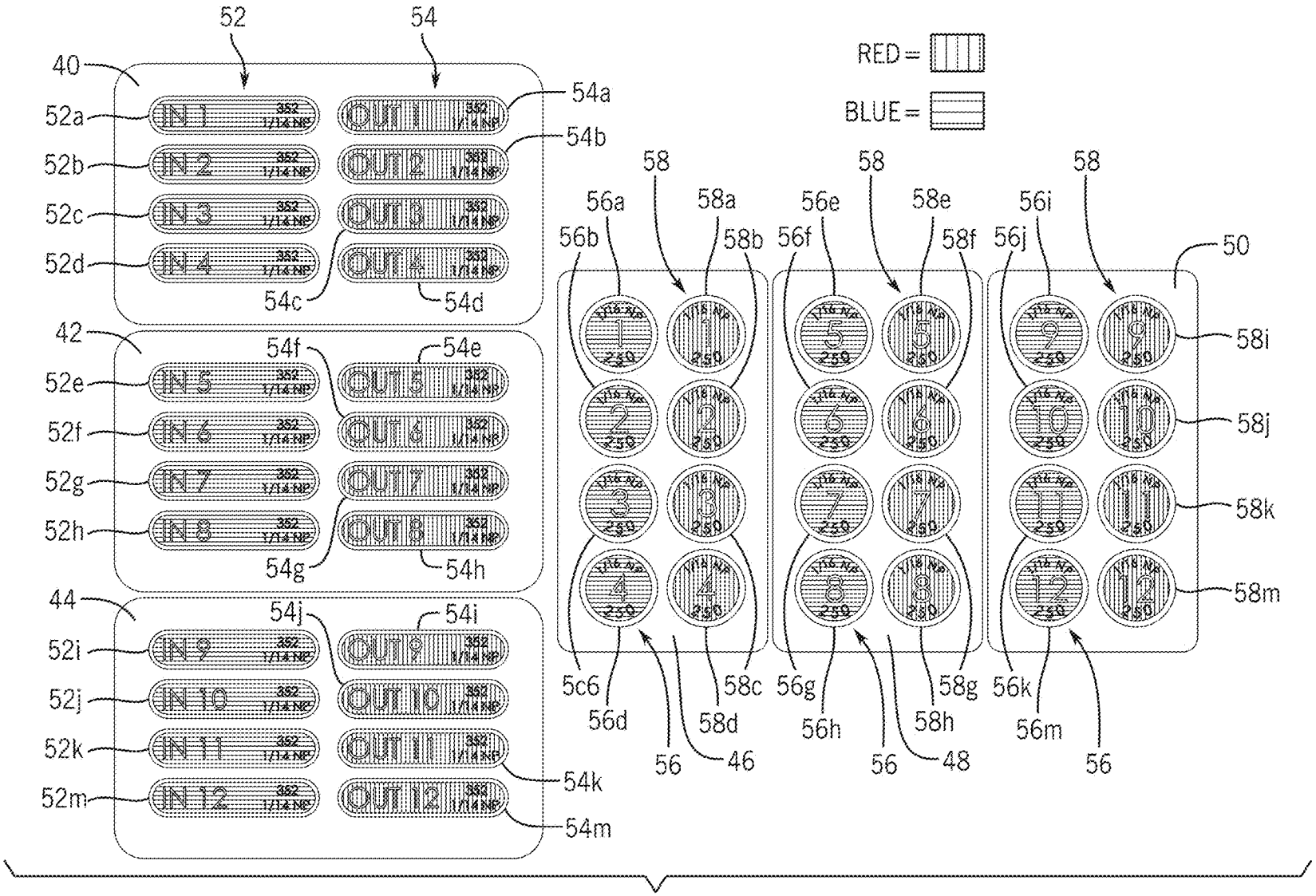
FIG. 5. shows an example of a printed color inlay set according to the teachings of the present disclosure, the set including six cards with multiple removable inlays provided on each of the cards.

Commercial consideration has been given to the format to organize and offer these common inlays for consumption. Understanding that hundreds of individual inlays could be necessary on a given tool, a method that minimized effort to keep the inlays organized is imperative. To this end, the disclosed inlays are presented in a convenient card format, as shown in FIG. 5, with what is commonly known in the laser cutting industry as "tabs". One or more cards can be provided, depending upon the needs of a particular application, and each card can carry multiple tabs or inlays. The tabs are relatively thin, allowing the inlays to be flexibly removed from the cards, though the card can be fabricated from steel or metal. FIG. 5. shows six cards 40, 42, 44, 46, 48, and 50, each carrying a plurality of removable tabs or inlays. In this example, the cards 40-50 carry four different sets 52, 54, 56, 58 of printed color inlays 52*a*-52*m*, 54*a*-54*m*, 56*a*-56*m*, and 58*a*-58*m*.

With laser cutting, the present disclosure affords the opportunity to offer various industries or specific customers their preference of inlay shape/geometry within a convenient and organized format and with their preference indicia included. In the disclosed example, the first set of inlays 52*a*-52*m* (excluding "1" or "L") have an oval shape, a blue background, the flow direction "IN", individual circuit numbers 1-12, and additional pipe fitting information. The second set of inlays 54*a*-54*m* also have an oval shape but have a blue background, the flow direction "OUT", individual circuit numbers 1-12, and additional pipe fitting information. The third set of inlays 56*a*-56*m* have a circular shape, a blue background, individual circuit numbers 1-12, and additional pipe performance and fitting information. The fourth set of inlays 58*a*-58*m* also have a circular shape, but have a red background, individual circuit numbers 1-12, and additional pipe performance and fitting information. Thus, for this system, the user requires twelve circuit identifiers and two different types or shapes of inlays with these twelve circuits identified.

The various tabs or inlays of a given system can be arranged in various ways on the cards, depending on the deeds of a given application or customer. In FIG. 5, the first card 40 carries the first four inlays 52*a*-52*d* and 54*a*-54*d* of the two oval inlay sets 52 and 54. The second and third cards 42 and 44 similarly carry the middle four inlays 52*e*-52*h* and 54*e*-54*h* of the two oval inlay sets 52 and 54 and the last four inlays 52*i*-52*m* and 54*i*-54*m* of the two oval sets of inlays 52 and 54, respectively. Likewise, the fourth card 46 carries the first four inlays 56*a*-56*d* and 58*a*-58*d* of the two round inlay sets 56 and 58. The fifth and sixth cards 48 and 50 similarly carry the middle four inlays 56*e*-56*h* and 58*e*-58*h* of the two round inlay sets 56 and 58 and the last four inlays 56*i*-56*m* and 58*i*-58*m* of the two round inlay sets 56 and 58, respectively. The number of inlay sets, the number of inlay types, the inlay shapes and sizes, background colors, indicia type, size, color, etc. and the like, can vary considerably. Likewise, the size, shape, and number of cards, and the inlay arrangement on the cards, can also vary considerably.

Figure 6:
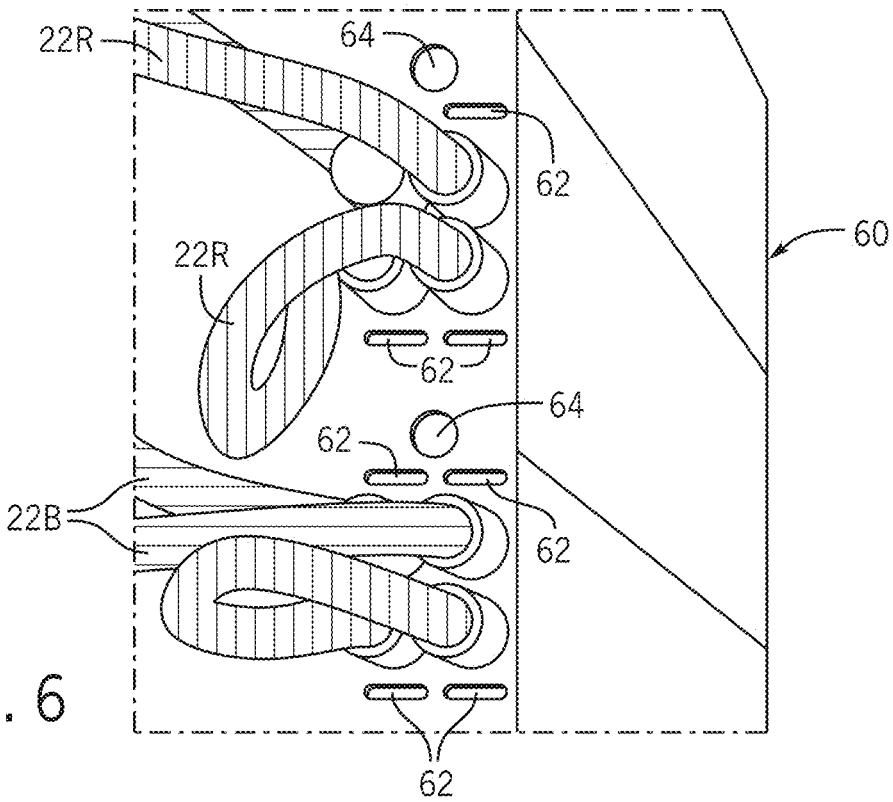
FIG. 6 shows an example of a mold half modified according to the teachings of the present disclosure to include inlay pockets associated with the various water connections.
Figure 7:
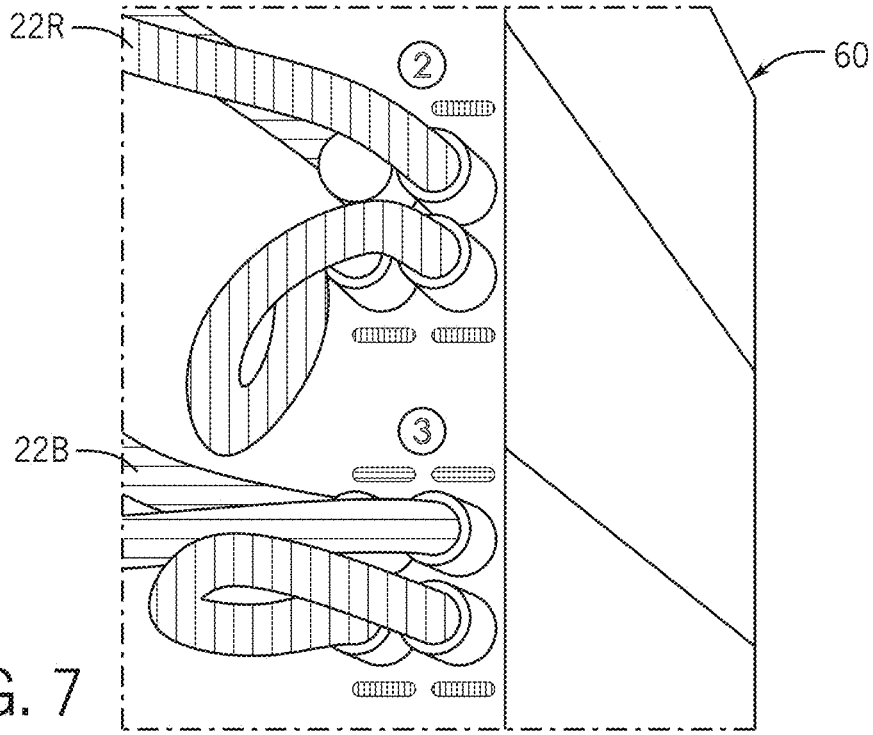
FIG. 7 shows the mold half of FIG. 6, but with an inlay disposed in each of the inlay pockets.

FIG. 6 shows a portion of a mold part 60, similar to the mold half 20 described above, but having been modified to include a plurality of inlay pockets 62 and 64. The inlay pockets 62 and 64 are each configured to receive therein one of the inlays shown in FIG. 5. Thus, the inlay pockets 62 are oval shaped and the inlay pockets 64 are round or circular in shape to receive the correspondingly shaped inlays. The inlay pockets 60 and 62 can be formed in a surface 64 of the mold part 60. These pockets can be laser cut or machined or otherwise formed in the material of the mold part 60 by the manufacturer, by a special technician, or by the end user. FIG. 7 shows the mold part 60 of FIG. 6, but after an inlay has been inserted or installed in each of the inlay pockets.

The inlay product is one element of the disclosed identification system. The second element is a hose or wire connection identifier for making connections to a supply source. With reference to FIGS. 1 and 2, groupings of hoses, such as the hoses 22R and 22B, may be and are often bundled together to connect to the supply source. This makes isolating a single circuit and a single hose, when necessary, very challenging for a single employee. A better way is to add an identifier element at both ends of each hose (or wire in an electrical circuit) with matching numbers. It is important to know that end users have an inventory of hose assemblies (hose with male and female connectors) of different sizes and with different connectors and sized at various lengths. The inventory is available for connecting the supply source to the tooling. I can be difficult to find and select the correct hose for a particular installation or connection among many such installations and connections.

Figure 8:
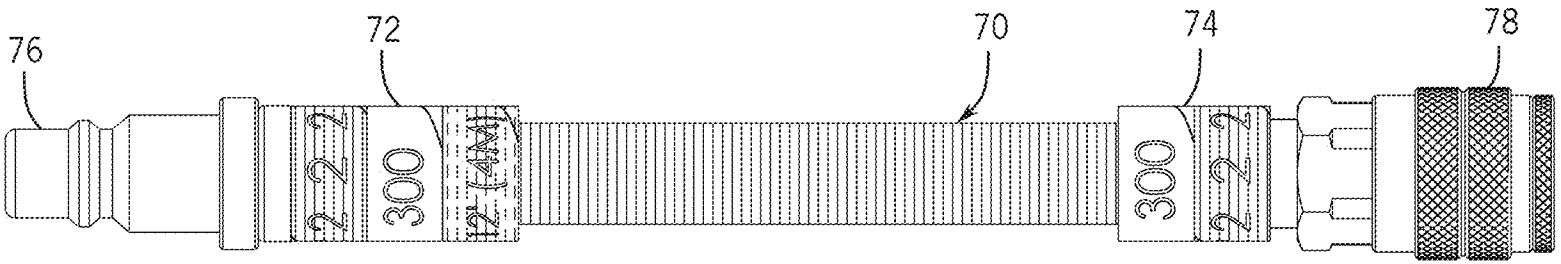
FIGS. 8-10 show examples of indicia wrapping elements for hoses, wires, and the like according to the teachings of the present disclosure.

Thus, an additional identifier element denoting a connector size or style can also be utilized for selecting the proper hose from such an inventory while another identifying element for the hose length may be helpful in selection as well. One such combination of identifying elements is shown in FIG. 8. FIG. 8 shows a hose 70 with a first identifier element 72 wrapped around the hose at one end and a second identifier element 74 wrapped around the hose at the other end. The hose 70 has a male quick connect fitting 76 at the one end and a female quick connect fitting 78 at the other end. The hose 70 itself may be of a specific color and the identifier elements 72 and 74 may include color coding as well. Each identifier element 72, 74 may also include other indicia representative of various aspects of the hose. The indicia may indicate hose type (air, water, dry air, actuator air, non-lubricant air, etc.), connector size, connector type, hose length, hose diameter, intended series or circuit usage, and the like.

In the case of pneumatic hoses, it is imperative in certain applications to add a lubricant to the compressed air stream as is the case with pneumatic actuators. Yet other applications, such as air poppet devices, which is a device where compressed air is used to assist in molded part ejection, may require the air supply be free of any lubricants or foreign particulate that would contaminate the mold and molded articles. Thus, it may be important that pneumatic hoses for the actuators be identified using one or more identifiers and that air poppet device hoses be identified using one or more different identifiers. Another example is that of tools, like impact wrenches, that generally require lubrication within the air stream. However, a pneumatic paint gun requires an air supply free of contaminants. Therefore, once a hose has been used to deliver a lubricated air stream, it should not be used when "clean" air is required. Yet another example is that of 2-part compounds like epoxies and others where a catalyst and base are kept separate and often conveyed through hoses to be mixed downstream. These hoses should never be interchanged, as any residual catalyst within the catalyst hose would cause curing of the compound within the hose. While the examples given illustrate specific sets of circumstances, the spirit of adding identifying elements to further enhance the specific nature and use of a hose in conveyance of a medium is a benefit that would save industry end users from contamination of media within the hose.

Figure 9:
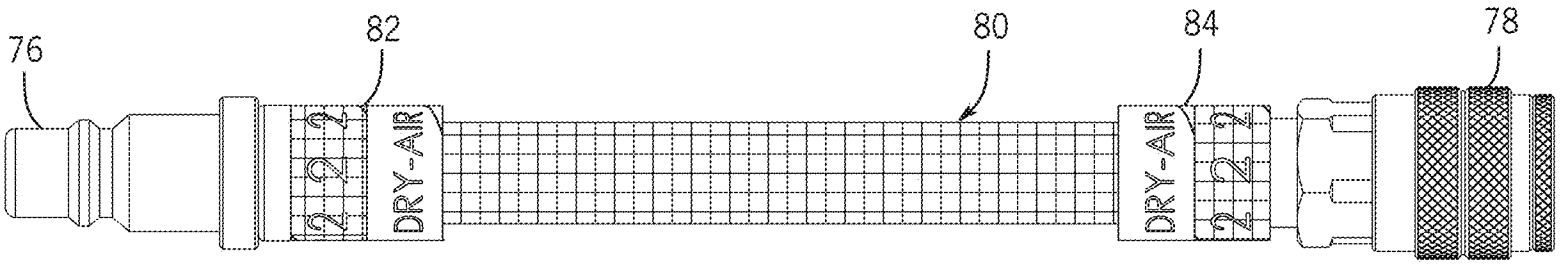
Figure 10:
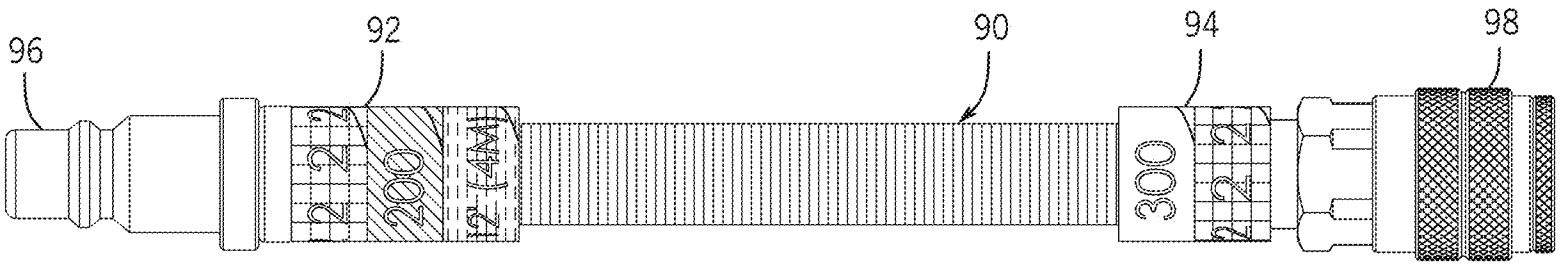

A configuration of another such air hose 80 with a different color hose body and identifying elements 82 and 84 at opposite ends of the hose is shown in FIG. 9. The identifier elements 82 and 84 provide different indicia specific to the hose characteristics. In the example in FIG. 8, the identifier elements 72 and 74 at each end indicate a 300 series 300, which could not be used with the circuit or the connector that has 200 series or 500 series connectors. It can also be that connectors from the supply and connectors on the tool are not the same series. FIG. 10 shows an example of a hose 90 with dissimilar connectors 92 and 94 of different sizes at opposing ends. In this example, the male connector 92 of the hose 90 is a 200 series male connector at one end and the female connector 94 of the hose is a 300 series female connector at the other end. The disclosed identification system and method allow for clear identification of the connector size at each end by adding a specific identifier element at each appropriate end. This same approach can be adopted for other services with appropriate markings as desired in industry.

In addition to the proper identification of the services mentioned, the disclosed system and method can also be applied to what is commonly referred to as hoist rings, swing eye bolts, eyebolts, and the like. Currently, when eyebolt holes in componentry are identified, they are simply marked with similar methods as previously described. One must be close enough to the tool to see the light refraction permitting legibility of an engraved part. This again is problematic if the employee is not English speaking or of limited literacy. As eyebolt thread sizes are not easily distinguishable from a distance, the disclosed system allows for unique color coding and labeling of all eye bolt thread sizes so that, from a distance, the proper size eyebolt with a matching color identifier element can be selected for the lifting task. Other indicia may also be applied using the disclosed system and method, if desired, as well.

Figure 11:
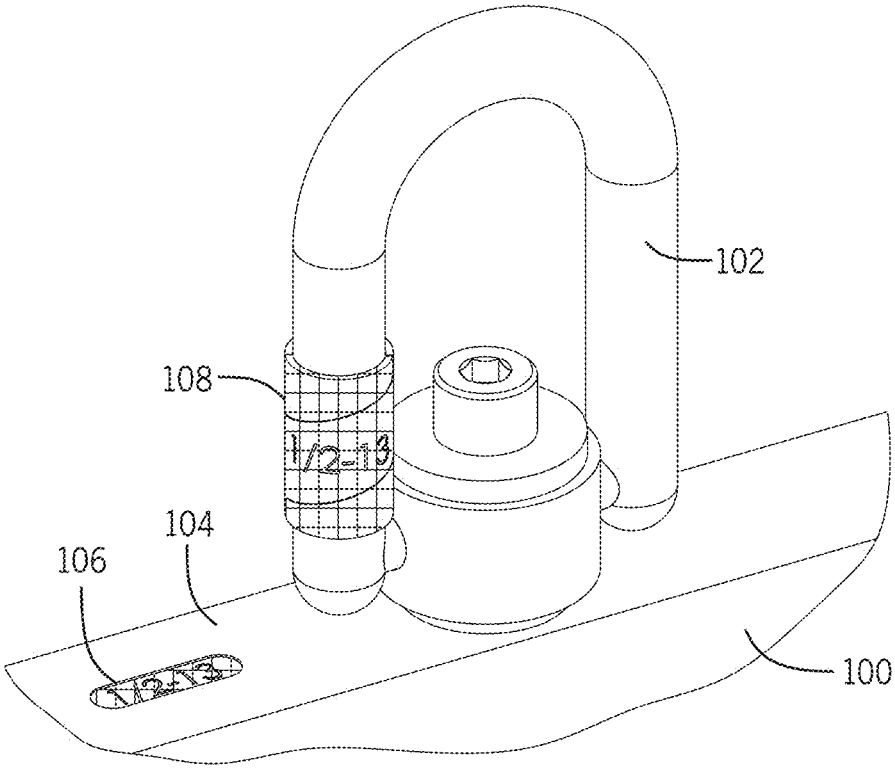
FIGS. 11-13 show examples of inlays and indicia wrapping elements that are color coded according to the teachings of the present disclosure to match corresponding lift bolt size and threaded holes on a mold plate or tool.
Figure 12:
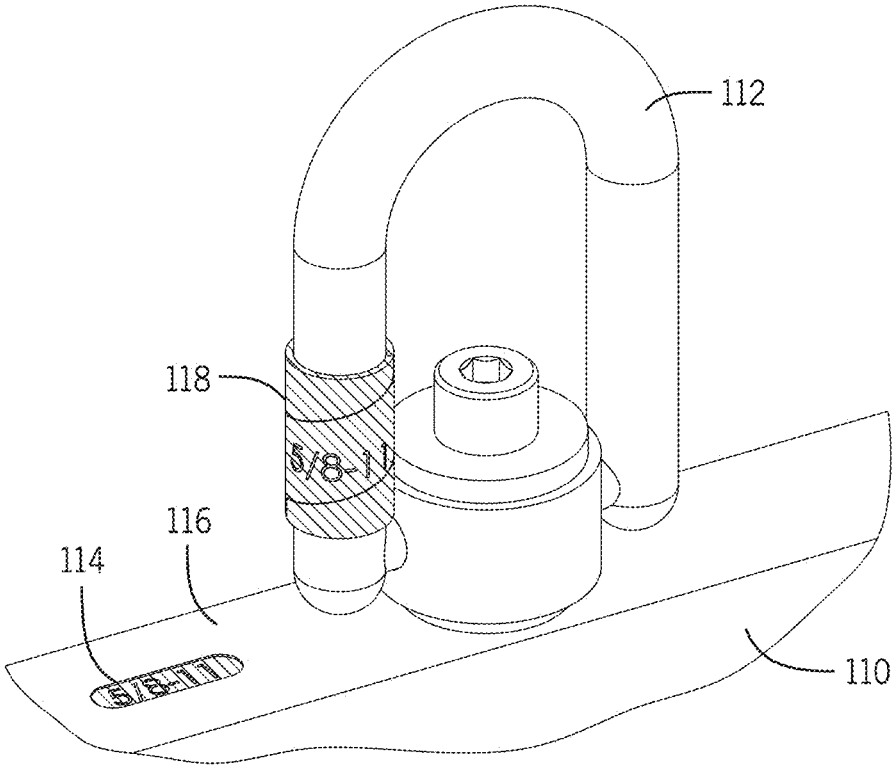
Figure 13:
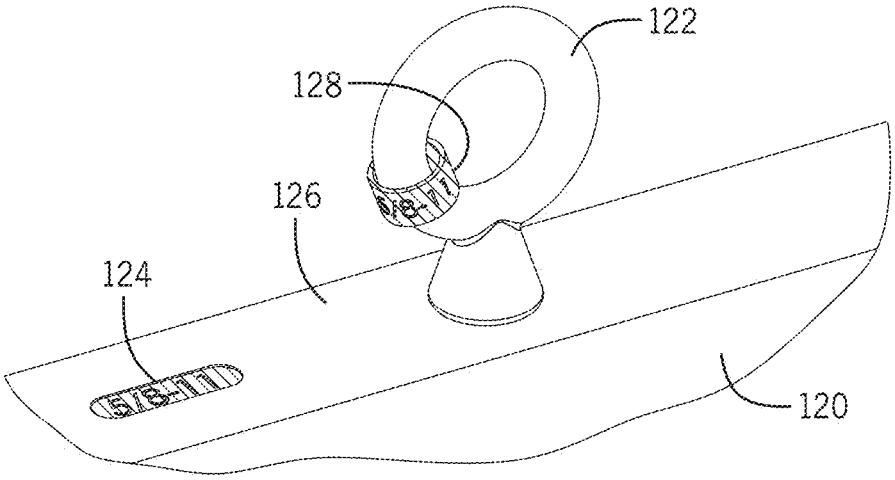

FIG. 11 shows one example of a component 100 with an installed hoist ring 102. A surface 104 of the component 100 has a pocket formed thereon and an inlay 106 disposed in the pocket. The hoist ring has an identifier element 108 attached or wrapped around a portion of the ring. The inlay 106 and identifier element 108 can be matched by color coding, by common indicia, such as thread size, gage, ring size, and the like FIG. 12 shows another example of a component 110 with a hoist ring 112 attached. An inlay 114 is disposed in a pocket on a surface 116 of the component. The inlay 114 has color coding and indicia that match the various color coding and indicia of an identifier element 118 on the hoist ring 112. FIG. 13 shows another example of a component 120 with an eyebolt or lift bolt 122 attached to the component. An inlay 124 is disposed in a pocket on a surface 126 of the component 120. The inlay 124 has color coding and indicia that match the various color coding and indicia of an identifier element 128 on the eyebolt 122.

Identifier elements used to mark hoses, wires, eyebolts and the like, may be expected to be formed of a resin, in one example, with spiral separation allowing the element to be wrapped around the hose, wire, eyebolt or hoist ring component, or the like without the need for disassembly or, in the case of a plain eyebolt, where disassembly is not possible. The identifier elements can be provided in rolls or coils of such elements that are separable from one another. Alternatively, such identifier elements may be provided in sheets with separable identifier elements.

Figure 15:
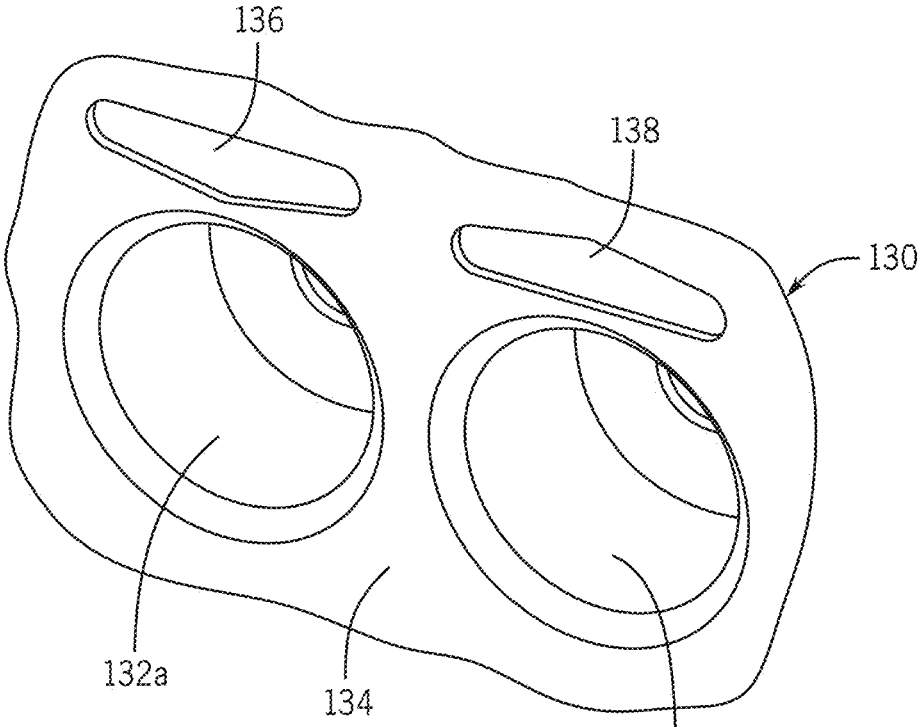
FIG. 15 is an enlarged view of a portion of the mold half of FIG. 14 and depicting two water connection ports thereof.
Figure 14:
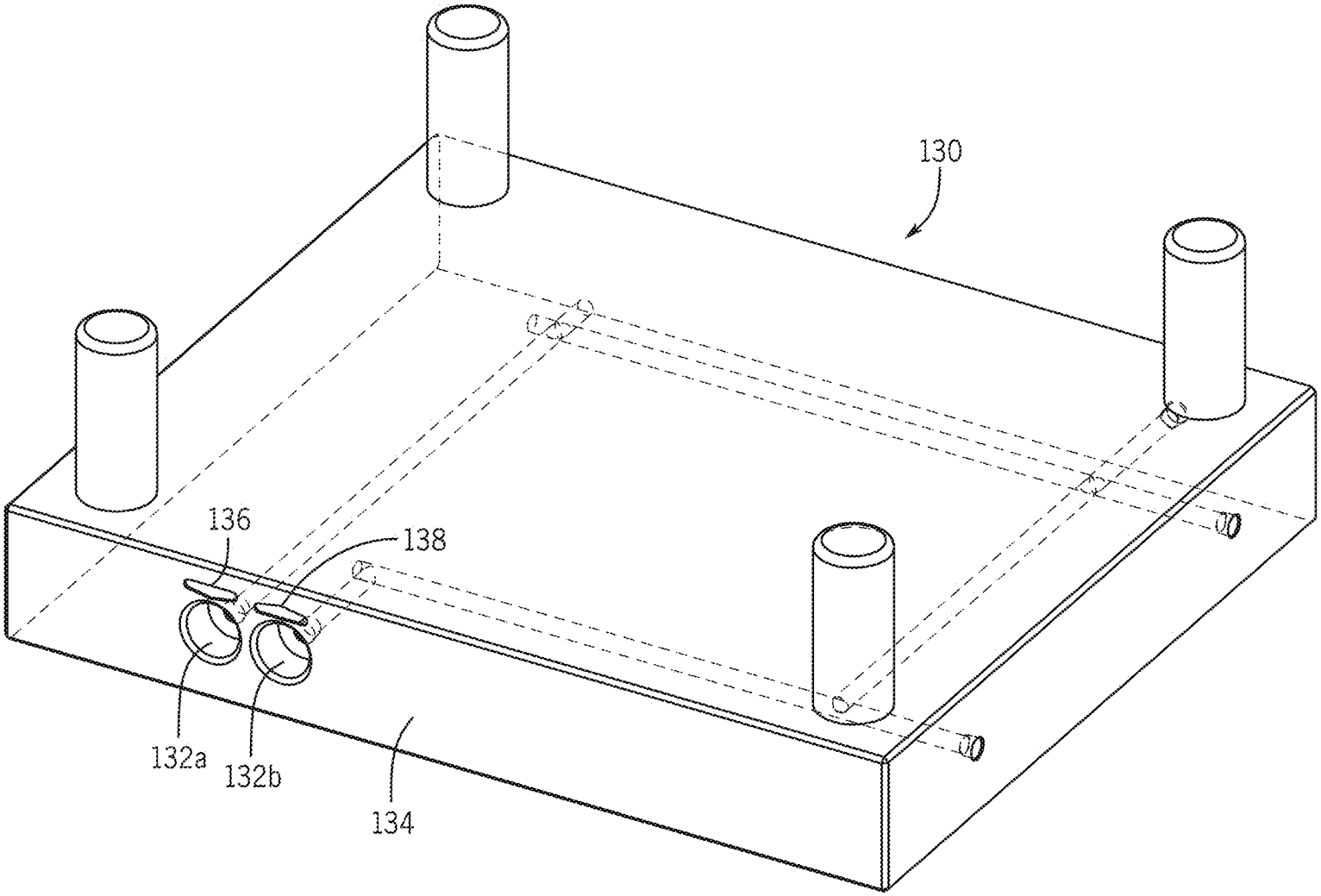
FIG. 14 shows an alternative example of a mold half modified according to the teachings of the present disclosure.

FIGS. 14-19 illustrate another example of an inlay system and method. In this example, the inlays and pockets have a different shape that those previously described. FIGS. 14 and 15 show a tool element or mold part 130 with two connector ports or coupling point 132*a*, 132*b* on a surface 134 for attaching water lines or other hoses to the part. Two inlay pockets 136 and 138 are formed in the surface 134. In this example, the inlay pockets 136 and 138 have a Chevron shape with a direction arrow or point on one side. The pocket 136 is directed with the arrow pointed toward the port 132*a*, indicating an "IN" flow direction. The pocket 138 is directed with the arrow pointed away from the port 132*b*, indicating an "OUT" flow direction.

Figure 16:
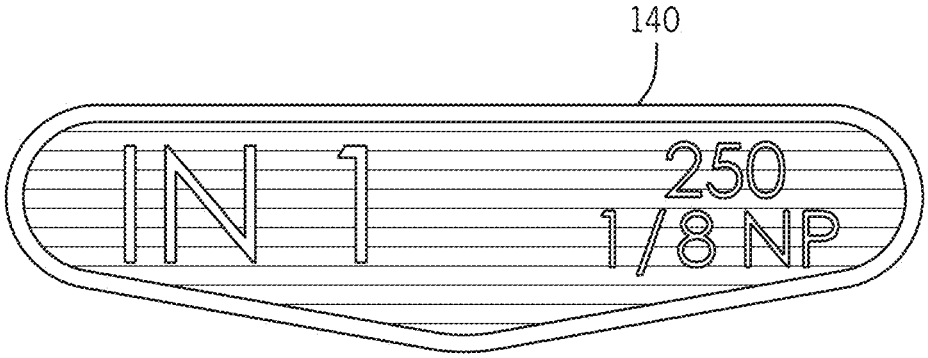
FIGS. 16 and 17 show alternative examples of digitally printed, different color inlays according to the teachings of the present disclosure and configured for the mold half of FIGS. 14 and 15.
Figure 17:
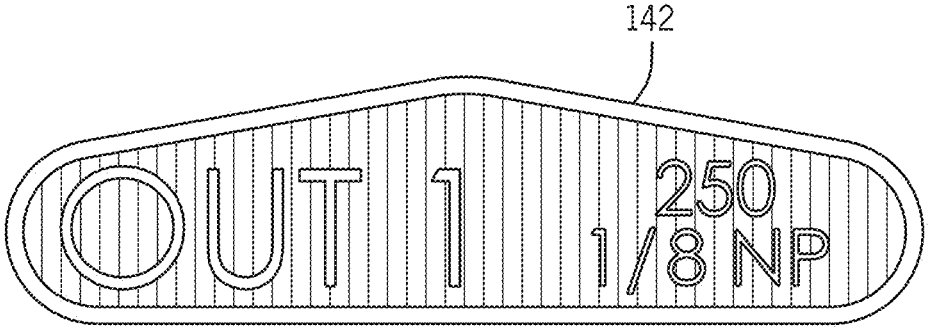
Figure 18:
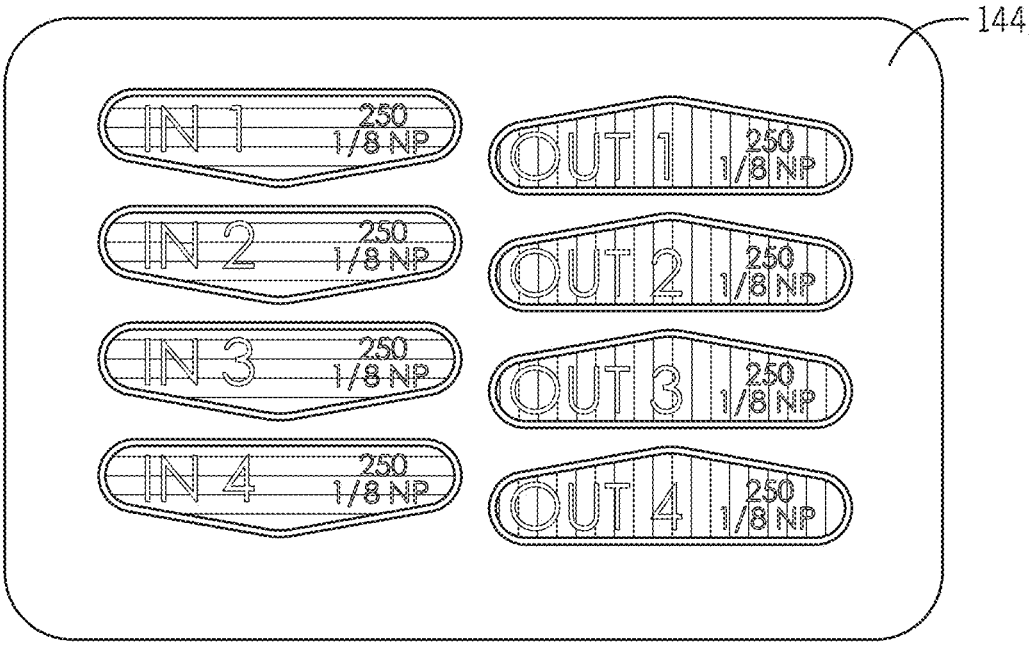
FIG. 18 shows an example of a printed color inlay card according to the teachings of the present disclosure, the card including multiple removable inlays of the type depicted in FIGS. 16 and 17.
Figure 19:
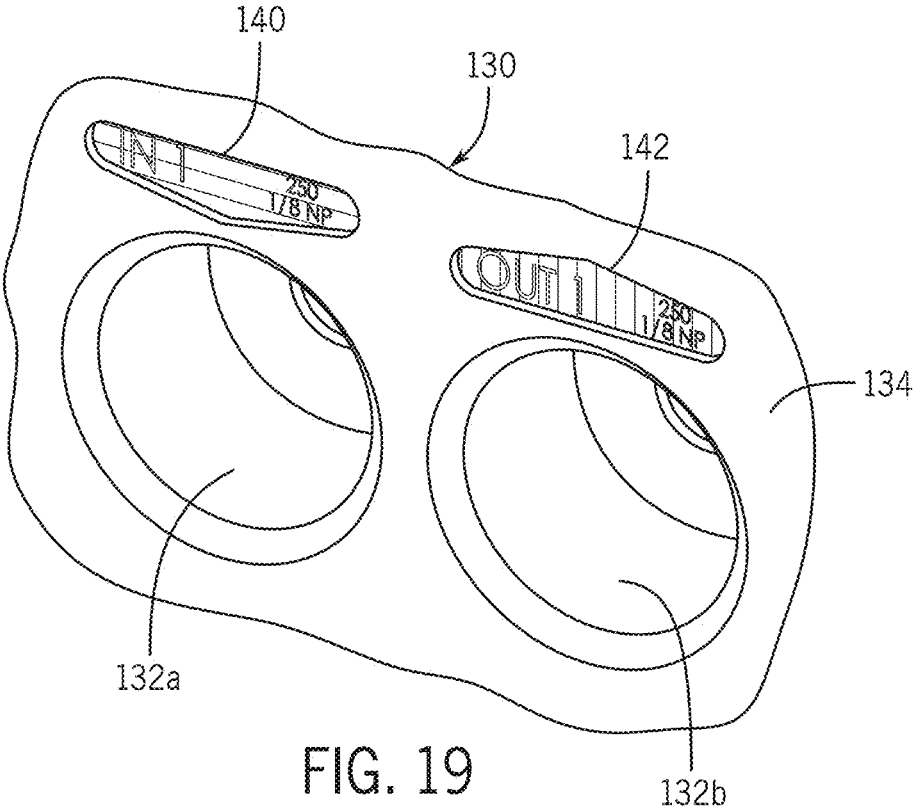
FIG. 19 shows the portion of the mold half depicted in FIG. 15 with the inlays of FIGS. 16 and 17 installed.

FIGS. 16 and 17 show another example of two different inlays 140 and 142, each also having a Chevron shape. Each inlay 140, 142 is otherwise similar to the above described inlays 26, 28 and inlay systems 52 and 54 regarding color coding, indicia, and the like. Like the above described inlay system and method, the inlays 140 and 142 can be provided as a part of a system and included on a card 144, as shown in FIG. 18, with other inlays for the system. Also, as shown in FIG. 19, the inlays can be disposed in an appropriate pocket on the mold part 130 to assist in finding, selecting, and connecting the proper hose or line for the proper circuit of a component system or mold tool.

Figure 20:
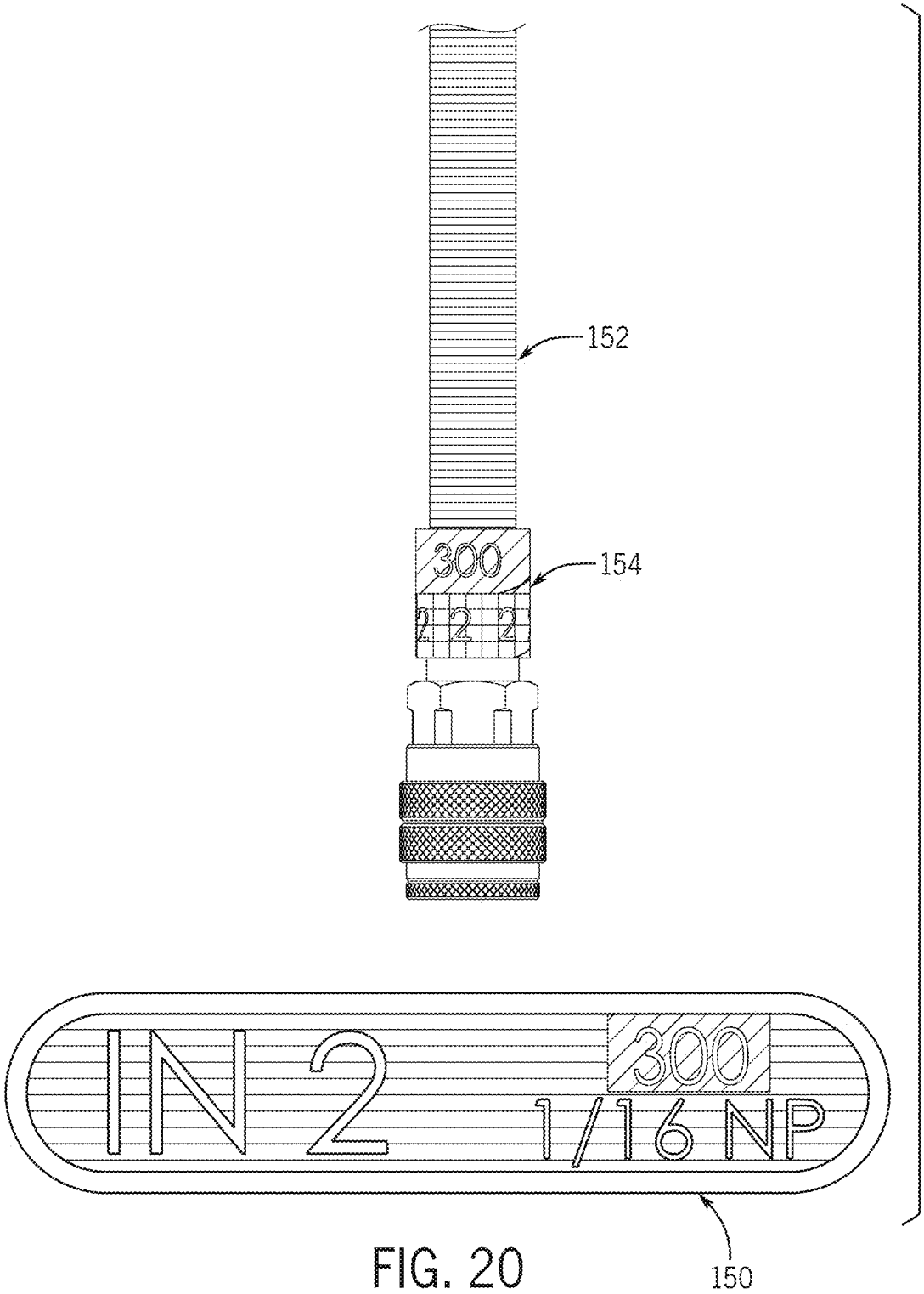
FIG. 20 shows an alternative example of an inlay and an indicia wrapping element that are color coded according to the teachings of the present disclosure.

FIG. 20 shows another example of a modified inlay 150, similar to the inlay of FIG. 3, and one end of a hose 152 with a modified identifier element or wrap 154. The connector size can be indicated with a matching number on each of the inlay 150 and the hose 152. Also, separate color match can be provided associated with the connector type. As shown in FIG. 20, the color of the background for the "300" text on the inlay 150 can match the color on the "300" of the identifier or wrap 154 on the hose 152. As will be evident to those having ordinary skill in the art, other indicia combinations, either singular or cumulative (as in FIG. 20), may be utilized within the spirit and scope of the disclosure.

The present disclosure improves industry efficiency across a broad spectrum of specific tooling and interfaces in everyday manufacturing. The product system is not only beneficial with respect to common nomenclature, but it makes possible unlimited iconography for identification of the finished product, special instructions, asset marking, component matching, and so on.

An asset inlay has been in use for decades. Generally, these have been limited to pre-defined information sets, certainly as pertaining to company names, logos, and the like. It is known to have multiple asset inlay tags and/or information inlays for brand recognition, promotion, instructional information, coding systems for information retrieval, and so on. This system with high-resolution digital print allows for combining as much as desired to a single inlay.

Prior art engraving and simple asset tags have been used for information that is mundane and neither of these methods uses or suggest a pictorial image of the actual part that could be produced in the tool. An existing asset inlay includes color graphics, logos, basic information, and set up information or instructions. The asset inlay has full-color graphics, logos, basic information, as well as relevant setup information. None of these prior known marking methods is provided for the function of properly identifying and matching various components of a system for properly assembling the component system. The disclosed system and method can be customized for any combination of company, customer, product, and so on, as required, and can add a logo inlay for a company, in any format desired. Further, the aesthetics can match the common inlay for cooling and services in appearance, which can create a uniform look about the entire tool.

As the industry has evolved it has become a challenge to include information in a predetermined uniform format. An example would be what is commonly referred to as a 2-shot mold, as in the case of a toothbrush, where there is a rigid plastic and an elastomer molded in the same tool. As another example, a flip top closure has been depicted on an inlay with a silicone valve molded into a single part. This type of asset inlay has full-color graphics clearly illustrating the final part, fabricator's logo and information, customer's logo and asset information, set up information, and common tool information. Again, three existing marking methods do not provide identification and matching among various components of a component system.

A typical asset tag would not have a layout allowing for multiple materials, multiple nozzle tips, multiple processing temperatures, and so on. There are also Quick Response ("QR") codes that direct viewers to the fabricator's website. These QR codes or like codes could be expanded to include direct and/or limited access to critical design information of all or distinct componentry, sub-assemblies, and so on. There are systems that use QR codes in combination with a specific application for use with smart devices. This simplifies access to the original manufacturers' website without needing a dedicated application or subscription to a service. The disclosed system and method can incorporate such QR code technology, if desired.

In the disclosed examples, the inlay and pocket can be configured such that the inlay nests or seats within its respective pocket such that the visible surface, i.e., the outward facing or outer most surface, of the inlay sits flush with the surface of the component or part that surrounds the pocket. For example, see FIGS. 11-13 where the visible surface of the inlays 106, 114, and 124 is depicted as lying flush with or parallel to the surface of the tool or component 120 that surrounds the pocket. Alternatively, the inlay and pocket can be configured such that the inlay nests or seats within its respective pocket such that the visible surface, i.e., the outward facing or outer most surface, of the inlay sits sub flush with the surface of the component or part that surrounds the pocket. For example, see FIG. 19 where the visible surface of the inlays 140 and 142 is depicted as lying recessed below, i.e., sub flush with, the surface of the tool or component 134 that surrounds the pocket. For certain types of tooling, the inlay labels should not protrude at all from the pockets. Industrial tooling components are often in need of maintenance and tooling plates, tooling components, molds, and the like can be heavy. During tooling installation or during the course of necessary maintenance work, these types of tooling plates, components, molds, and the like may be slid across works surfaces. If the label is not inlayed and is not flush with or sub flush with the tooling surface, the label will become dislodged and lost.

Although certain inlay labelling for identifying and matching related components in an apparatus has been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. An inlay system for identifying and/or matching corresponding parts of an apparatus, the inlay system comprising:

a color coding on a visible surface of an inlay;

a pocket formed in a surface of the apparatus, the inlay inserted in the pocket, which is positioned to identify a first part of the apparatus; and a matching color coding on a second part of the apparatus to be coupled to the first part, wherein the apparatus is industrial tooling with a first part and one or more second parts to be connected to the first part and configured to provide one or more peripheral services to the first part.

2. The inlay system of claim 1, wherein the inlay is provided on and removable from a card carrying a plurality of inlays.

3. The inlay system of claim 2, wherein the card and the plurality of inlays are or have a metal substrate.

4. The inlay system of claim 1, wherein the inlay further comprises indicia on the visible surface indicative of characteristics of the first part of the apparatus.

5. The inlay system of claim 1, wherein the matching color coding is on an identifier element attached to the second part of the apparatus.

6. The inlay system of claim 1, further comprising:

one or more additional pockets formed in the surface or in one or more additional surfaces of the apparatus, each of the plurality of pockets containing an inlay with color coding and positioned to identify a different part of the apparatus, wherein each of the inlays having a visible surface that is flush with or sub flush with a portion of the corresponding surface that surrounds the respective pocket.

7. The inlay system of claim 1, wherein the system is configured to be used by at least one of fabricators during fabrication of the apparatus or end users during installation or set up of the apparatus.

8. The inlay system of claim 1, wherein the industrial tooling is molding equipment having at least one of recirculating cooling mediums, compressed air equipment, vacuum equipment, hydraulic auxiliary equipment, electrical auxiliary equipment, hoist rings, and/or eyebolts, and wherein the system is applied to any one or more of these on the molding equipment.

9. The inlay system of claim 1, wherein the one or more peripheral services include compressed air, oil, heating fluid, and/or cooling fluid.

10. The inlay system of claim 1, wherein the visible surface of the inlay is flush with or sub flush with a portion of the surface of the apparatus that surrounds the pocket.

11. A method for identifying and matching corresponding components in an apparatus, the method comprising:

attaching a first inlay on a first part of an apparatus within a pocket formed in a surface of the first part, the first inlay carrying at least one indicia on a visible surface indicative of a first characteristic of the first part; and attaching a second element on a second part of an apparatus, the second element carrying a matched indicia to the at least one indicia indicative of a second characteristic of the second part that corresponds to or matches the first characteristic of the first part, wherein the visible surface of the first inlay is flush with or sub flush with a portion of the surface of the apparatus that surrounds the pocket.

12. The method of claim 11, wherein the step of attaching a second element includes positioning an identifier element around a portion of the second part.

13. The method of claim 11, wherein the matched indicia and the at least one indicia are the same color, number, or word.

14. The method of claim 11, wherein the at least one indicia includes connector size information and the matched indicia includes matching connector size information.

15. A system for identifying or matching corresponding components of an apparatus, the system comprising:

pockets formed in corresponding surfaces of the apparatus, each pocket disposed adjacent a different part of the apparatus;

an inlay disposed in each of the pockets, each inlay having at least one indicium associated with a specific characteristic of the corresponding different part of the apparatus, the at least one indicium on a visible surface of the respective inlay and the visible surface is flush with or sub flush with a portion of the corresponding surface of the apparatus that surrounds the respective pocket;

other parts, each other part having a characteristic that corresponds to the specific characteristic of one of the different parts and configured to be coupled to the respective one of the different parts; and an element carried on each of the other parts, each element having an indicium that matches the at least one indicium of the inlay associated with the respective one of the different parts.

16. The inlay system of claim 15, wherein the apparatus is molding equipment having at least one of recirculating cooling mediums, compressed air equipment, vacuum equipment, hydraulic auxiliary equipment, electrical auxiliary equipment, hoist rings, and/or eyebolts, and wherein the system is applied to any one or more of these on the molding equipment.

17. The inlay system of claim 15, wherein the apparatus is industrial tooling and the other parts are configured to provide one or more peripheral services to the apparatus.

18. The inlay system of claim 17, wherein the one or more peripheral services include compressed air, oil, heating fluid, and/or cooling fluid.

19. A method for identifying and matching corresponding components in an apparatus, the method comprising:

attaching a first inlay on a first part of an apparatus within a pocket formed in a surface of the first part, the first inlay carrying at least one indicia on a visible surface indicative of a first characteristic of the first part; and attaching a second element on a second part of an apparatus, the second element carrying a matched indicia to the at least one indicia indicative of a second characteristic of the second part that corresponds to or matches the first characteristic of the first part.

20. A system for identifying or matching corresponding components of an apparatus, the system comprising:

pockets formed in corresponding surfaces of the apparatus, each pocket disposed adjacent a different part of the apparatus;

an inlay disposed in each of the pockets, each inlay having at least one indicium associated with a specific characteristic of the corresponding different part of the apparatus, the at least one indicium on a visible surface of the respective inlay;

other parts, each other part having a characteristic that corresponds to the specific characteristic of one of the different parts and configured to be coupled to the respective one of the different parts; and an element carried on each of the other parts, each element having an indicium that matches the at least one indicium of the inlay associated with the respective one of the different parts.

* * * * *